US007287900B2

(12) United States Patent
Rüfenacht et al.

(10) Patent No.: US 7,287,900 B2
(45) Date of Patent: Oct. 30, 2007

(54) MECHANICAL TIMEPIECE FITTED WITH A DEVICE FOR ADJUSTING THE SHAKE OF A ROTATING PART OR WHEEL SET

(75) Inventors: Christian Rüfenacht, Bienne (CH); Ivan Villar, Bienne (CH)

(73) Assignee: ETA SA Manufacture Horlogére Suisse, Grenchen (CH)

( * ) Notice: Subject to any disclaimer, the term of this patent is extended or adjusted under 35 U.S.C. 154(b) by 0 days.

(21) Appl. No.: 11/616,982

(22) Filed: Dec. 28, 2006

(65) Prior Publication Data

US 2007/0159931 A1 Jul. 12, 2007

(51) Int. Cl.
*G04B 15/00* (2006.01)
*G04B 17/00* (2006.01)

(52) U.S. Cl. ..... 368/127; 368/169; 368/173

(58) Field of Classification Search ..... 368/127–133, 368/161, 169–178
See application file for complete search history.

(56) References Cited

U.S. PATENT DOCUMENTS 824,466 A * 6/1906 Brun ..... 368/178
3,393,506 A * 7/1968 Garbe ..... 368/173
3,483,693 A * 12/1969 Smythe, Jr. ..... 368/173
3,653,199 A * 4/1972 Inoki et al. ..... 368/158

FOREIGN PATENT DOCUMENTS

| | | |
|---|---|---|
| CH | 20552 | 11/1899 |
| CH | 368752 | 12/1962 |
| FR | 1545748 | 11/1968 |

OTHER PUBLICATIONS

European Search Report issued in corresponding application No. EP 05 02 8552, completed Nov. 16, 2006.

* cited by examiner

*Primary Examiner*—Vit W Miska
(74) *Attorney, Agent, or Firm*—Griffin & Szipl, P.C.

(57) ABSTRACT

The timepiece includes means for adjusting the shake of a rotating part or wheel set, in particular a balance one bearing of which is arranged in a bar (4). This bar comprises a base (18) associated with a adjusting screw (34) one end (36) of which rests on the bottom plate. Rotating this adjusting screw varies the distance between the base and the bottom plate (14). The center of the adjusting screw is pierced for the passage of a tightening screw (32) for fixing the bar to the bottom plate. This adjusting screw is arranged in a hole (42) passing through the base (18) and can be rotated through the hole from the top face (46) of the bar in order to adjust the balance shake.

5 Claims, 4 Drawing Sheets

MECHANICAL TIMEPIECE FITTED WITH A DEVICE FOR ADJUSTING THE SHAKE OF A ROTATING PART OR WHEEL SET

This application claims priority from European Patent Application No. 05028552.7, filed Dec. 28, 2005, the entire disclosure of which is incorporated herein by reference.

FIELD OF THE INVENTION

The present invention concerns a mechanical timepiece fitted with a device for adjusting the shake of a rotating part or wheel set, in particular the shake of a balance.

BACKGROUND OF THE INVENTION

There is known from Swiss Patent No. 20552 in the name of J. L. Kurtz, filed on 1 Nov. 1899, a balance bar associated with means for adjusting the relative position of the two bearings in which the two ends of the balance staff or arbour respectively pivot. The balance bar described is of the simple type, i.e. with a single base secured to a bottom plate and a plate connected to one end of this single base and having at its other free end an aperture for arranging a bearing. The balance bar is secured to the bottom plate by a single screw passing right through the single base.

In this patent, the shake of the balance staff is adjusting by adjusting the height of the balance bar plate. Three regulating screws are provided for this purpose on the periphery of the tightening screw. The three regulating screws pass through the base of the bar and abut on the side of the bottom plate against three other complementary screws defining thus three points of abutment for the three adjusting screws. By screwing or unscrewing the three adjusting screws in a homogenous manner, it is thus possible to vary the height of the balance bar plate, i.e. to vary the relative distance of the plate to the bottom plate. According to this patent, the plate remains horizontal, i.e. parallel to the general plane of the bottom plate. Thus the watchmaker who adjusts the balance shake has to act on the three regulating screws by repeatedly rotating them in succession until the plate reaches a height that defines a proper shake for the balance. This is a significant drawback for assembling the timepiece and adjusting the balance shake. Moreover, three regulating screws increase the cost of the timepiece and their arrangement at the periphery of the tightening screw requires relatively large dimensions for the base of the bar. This raises a problem as to the design of the timepiece movement and in particular as to the arrangement of the balance bar.

A timepiece sold by the Rolex company is also known that has a system for adjusting the balance shake. In this timepiece, the balance bar is of the double type, i.e. having two bases arranged at the two ends of the bar plate and allowing the balance bar to be rigidly secured on either side of the bearing arranged substantially at the centre of the plate. The two bases are respectively secured to the bottom plate by two tightening screws. Each of the two tightening screws is screwed inside a cylinder driven into the bottom plate. This cylinder has an interior threading for the tightening screw and an exterior threading for an adjusting nut. The two bases of the balance bar are held abutting against the two nuts by the two tightening screws. A friction spring formed by a resiliently deformable washer is provided underneath the nut so as to hold the latter in position when it is not being actuated by a watchmaker. The two tightening screws are respectively provided at the periphery of the two respective bases so as to allow the adjusting nuts, which have flutes on the external lateral surface, to be rotated in order to facilitate activation thereof using a suitable tool and thus adjusting of the balance shake.

The system for adjusting the shake of a balance described above has certain drawbacks. First of all, it is relatively complex and expensive. Indeed, this system comprises two cylindrical parts, with an inner threading and an outer threading, which have to be driven into the bottom plate. Moreover, the system comprises two fluted adjusting nuts. Then, in order to adjust the height of the bar plate with the balance in place, the tightening screws have to be provided on the outer edge of the two bases and a free space must be left on the periphery of the two tightening screws in order to allow access to the adjusting nuts which come out laterally underneath the bases. This regulating system is thus relatively complicated and limits the possibilities for arranging the balance bar in the timepiece movement.

It is an object of the present invention to propose a device for adjusting the shake of a rotating part in a timepiece, in particular a balance, which is relatively inexpensive and enables the shake of the rotating part to be efficiently adjusting, without increasing the size of the bar concerned or limiting the arrangement of its peripheral area.

SUMMARY OF THE INVENTION

The present invention therefore concerns a mechanical timepiece fitted with a rotating part which comprises an arbour or staff one end of which pivots in a first bearing carried by a bar and the other end pivots in a second bearing arranged in a bottom plate, this timepiece comprising means for adjusting the shake of this arbour or staff of the rotating part.

The adjusting means according to the invention comprise at least one element for adjusting the distance between a base of the bar concerned and the bottom plate, the centre of this adjusting element being pierced for the passage of a tightening screw and able to be actuated through a hole passing through said base, said tightening screw being introduced into the through hole in order to secure said base to said bottom plate. Thus, when the adjusting element is actuated, the tightening screw is not in place in the through hole and the adjusting element is actuated from the top face of said bar which is opposite said bottom plate.

In particular, a adjusting screw arranged to vary the distance between the bases forms the adjusting element and the bottom plate by screwing in or unscrewing said adjusting screw.

According to a preferred embodiment, the adjusting screw is screwed into the bar and the tightening screw is screwed into the bottom plate. The adjusting screw has a first end abutting against the bottom plate and its second end has a form adapted to a tool for rotating it from said top face of the bar concerned.

BRIEF DESCRIPTION OF THE DRAWINGS

The present invention will be described hereinafter in detail with reference to the annexed drawing, given by way of non-limiting example, in which:

FIG. 1 shows a mechanical timepiece 2 fitted with a rotating part and comprising a device for adjusting the shake of this moving part according to the present invention.

DETAILED DESCRIPTION OF THE ILLUSTRATIVE EMBODIMENTS

Figure 1:
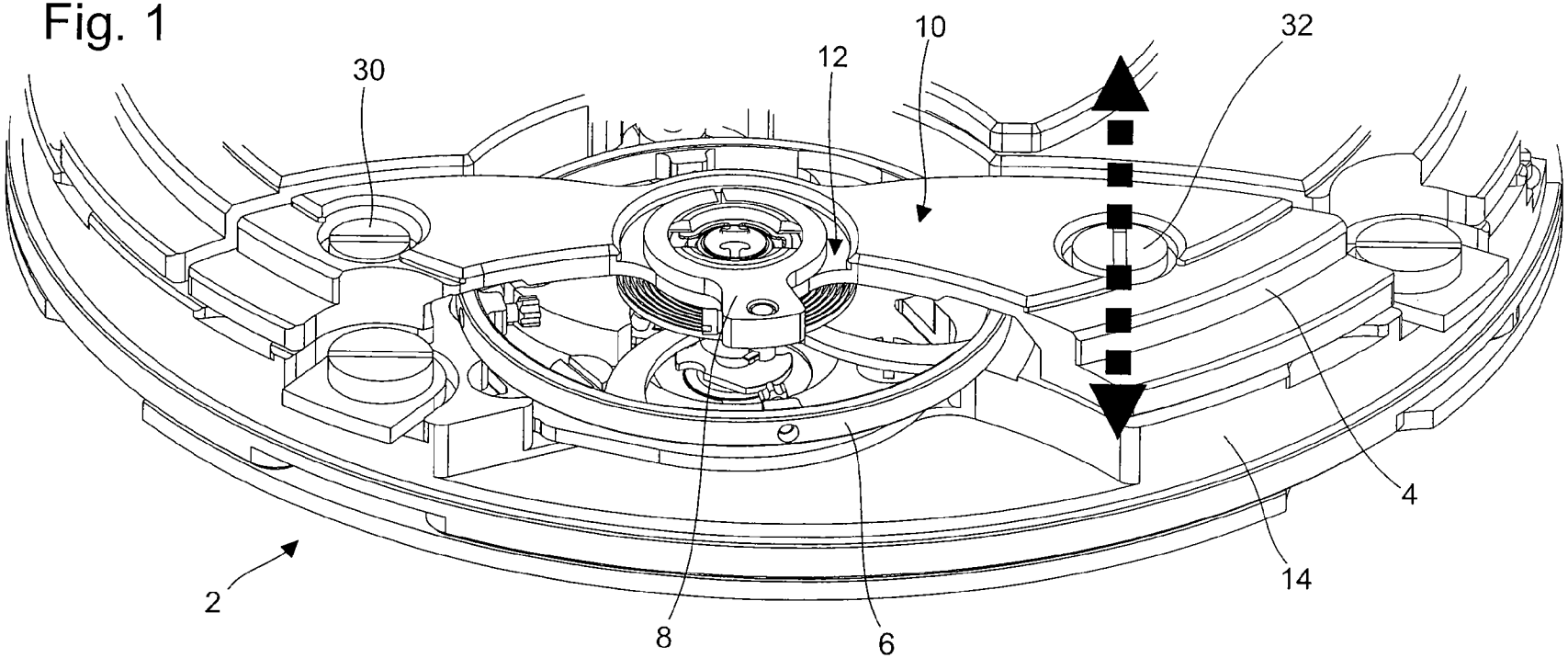
FIG. 1 is a partial perspective view of a timepiece movement having a balance bar fitted with a balance shake adjusting device according to the present invention.

A preferred embodiment of the invention will be described hereinafter with reference to FIGS. 2 to 5. The bar in this embodiment is a balance bar 4 and the rotating part is a balance 6. In a conventional manner, balance 6 comprises a staff or arbour one end of which pivots in a first bearing carried by the plate 10 of the balance bar. The first bearing is arranged in an aperture of a balance spring stud holder 8 with a shock-absorber device known to those skilled in the art. The balance spring stud holder 8 rests on the central seat 12 of bar 4. The second end of the balance staff pivots in a second bearing arranged in a bottom plate 14 of timepiece 2.

The balance bar 4 is a double bar formed of two bases 16 and 18 respectively arranged on either side of plate 10 and thus of the first bearing arranged in the central part 20 of said bar. Bar 4 includes two zones of less mechanical resistance, respectively arranged in the two end regions of plate 10, i.e. respectively between the two bases 16 and 18 and the central part 20 carrying the first bearing for the balance staff.

According to the invention, means are provided for adjusting the shake of the balance which are formed on the one hand by a screw 30, which secures base 16 to bottom plate 14 in a rigid manner leaving said base in a fixed position relative to the bottom plate, abutting against the latter. On the other hand, the second base 18 of bar 4 is associated with means for deforming bar 4, which is formed by a screw 34 of relatively large diameter and pierced at the centre thereof. This regulating screw 34 defines an element regulating the distance between base 18 of bar 4 and bottom plate 14. It includes a flat head 36 provided with a slot for screwing in the screw from the bottom part of the bar. Adjusting screw 34 further includes a cylinder 38 having an outer threading with a fine pitch in order to vary finely the distance between the external surface 37 of head 36 abutting against bottom plate 14 and the bottom surface 5 of bar 4. The hole 40 that passes through screw 34 has a larger diameter than that of tightening screw 32 so that the latter can be freely inserted into through hole 40.

Screw 34 is screwed into a hole 42 passing through base 18 of bar 4. Hole 42 has an enlarged portion in the top part of base 18 with a substantially flat annular surface acting as a stop member for the head of tightening screw 32. The bottom end of screw 32 is screwed into bottom plate 14 in order to secure base 18 to bottom plate 14.

Figure 4:
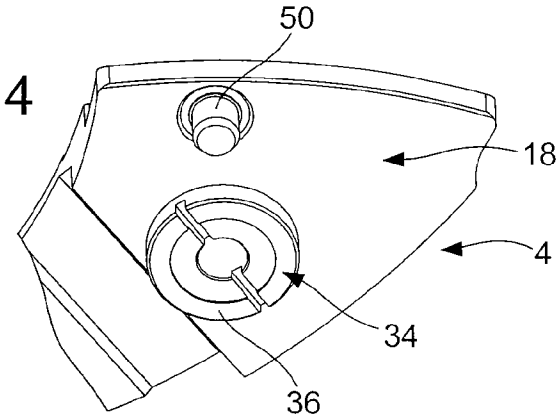
FIGS. 2 to 5 are various diagrams of a balance shake adjusting device according to the present invention fitted to the timepiece movement of FIG. 1.
Figure 5:
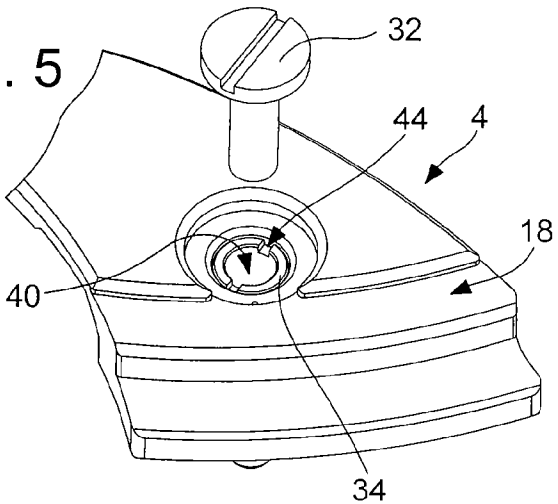
Figure 2:
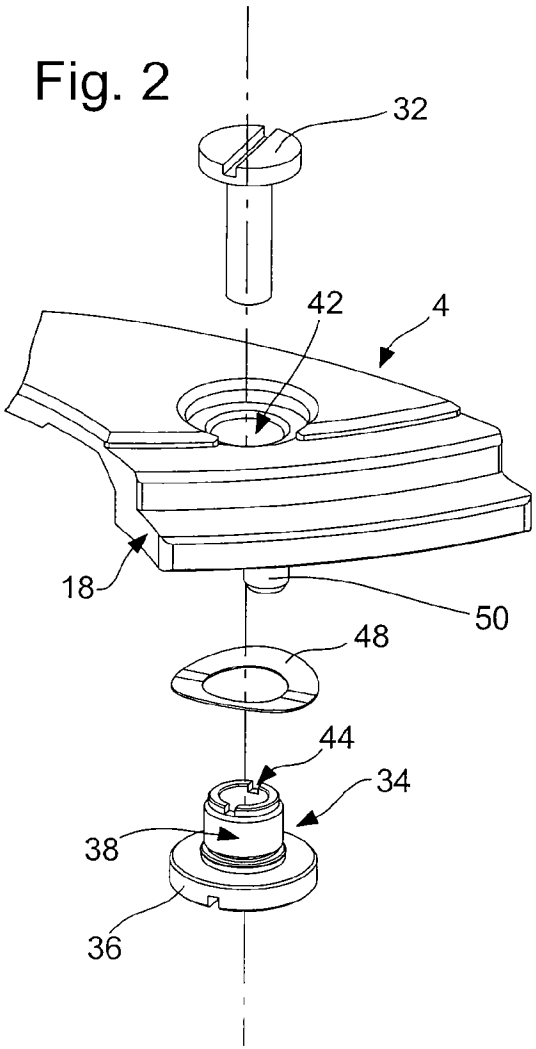
Figure 3:
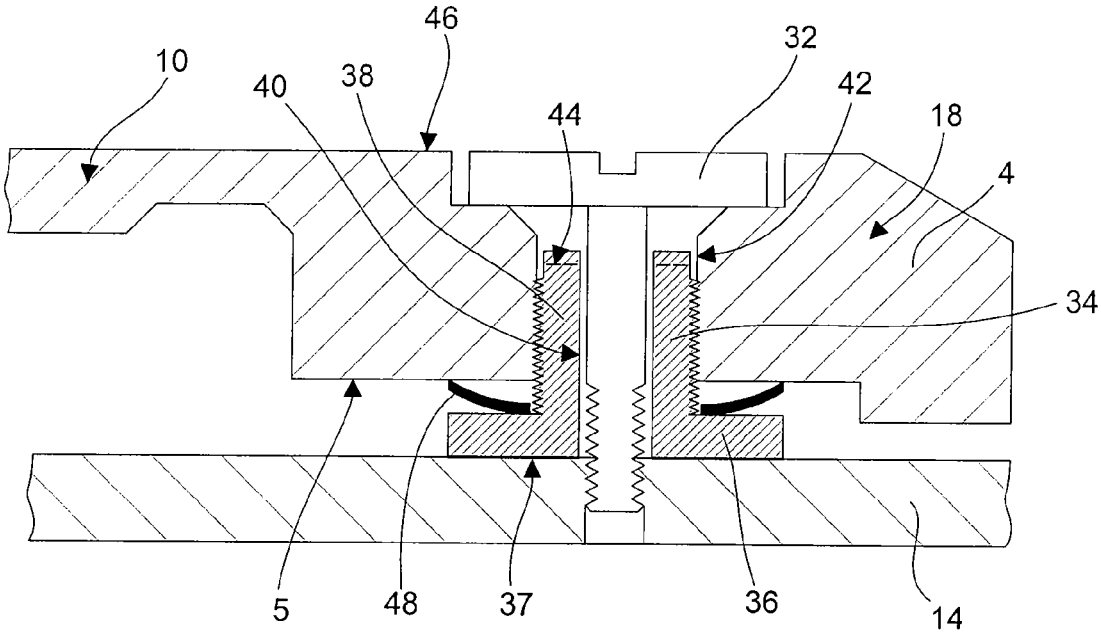
Figure 6:
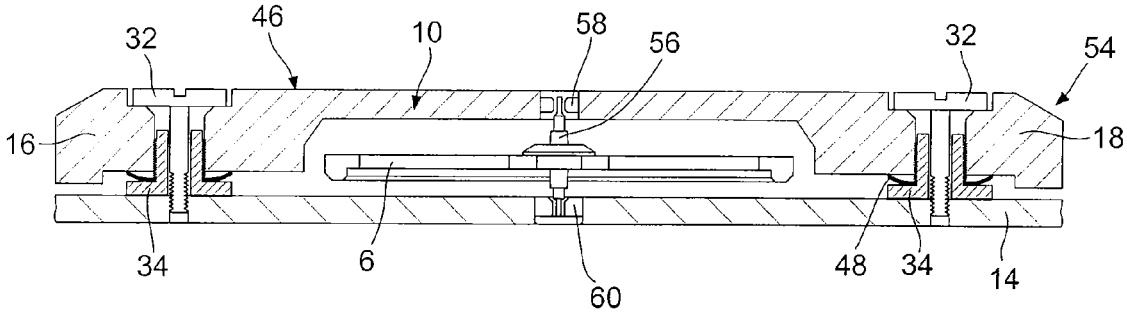
FIG. 6 is a cross-section of one embodiment with a balance bar having two bases each fitted with an adjusting device according to the invention.

Adjusting screw 34 has, at its top end, opposite head 36, a top annular part with two diametrically opposite slots 44 arranged to allow a screwdriver to be inserted therein in order to rotate said regulating screw 34 from the top face 46 of the bar in the absence of tightening screw 32, as is shown in particular in FIGS. 4 and 6. A friction spring, having the shape of a bent washer 48 is arranged between head 36 of screw 34 and the bottom surface 5 of base 18. A positioning pin 50 is provided in order to position base 18 in the general plane of timepiece movement 2.

Rotating adjusting screw 34 varies the relative distance between base 18 and bottom plate 14 given that the bottom surface 37 of head 36 rests on said plate. Tightening screw 32 is removed in order to adjust the height of base 18 from the top surface 46 of bar 4 through aperture 42. In order to do this, the watchmaker will hold screw 34 abutting against bottom plate 14, for example by using an appropriate tool, if this proves necessary. Given that base 16 is secured to the bottom plate in an invariable position, actuating adjusting screw 34 generates a deformation of bar 4 in the embodiment of FIG. 1. Thus, by actuating adjusting screw 34, the distance between base 18 and bottom plate 14 is varied and plate 10 is deformed such that the central zone 20, where the top bearing for the balance staff is situated, also undergoes a movement thereby adjusting the shake of the balance.

As already described previously, plate 10 comprises, at its two end parts, two zones of less mechanical resistance which each define a localised deformation zone or flexible hinge between the two bases 16 and 18. These zones decrease the overall stresses generated in balance bar 4 when base 18 is moved in height relative to base 16. Thus, the adjustment of the balance shake can generate here a certain inclination of central part 20 of plate 10, but this inclination remains small.

The embodiment described above is characterized in that adjusting of the shake of the balance or a rotating part is accomplished by means for deforming the bar concerned, these deformation means being arranged to be actuated by the variation in position of a single regulating element 34. Then, this variation can be carried out from the top face of the bar associated with the rotating part whose shake is being adjusting. Moreover, the coaxial arrangement of tightening screw 32 and adjusting screw 34 according to the present invention does not increase the space requirement of the bar and does not necessitate any clearance at the periphery of the latter.

The shake adjusting device is easily mounted simply by screwing in adjusting screw 34 from the bottom face 5 of bar 4 until its head is approximately at some defined height. Next, the bar can be assembled to the bottom plate with the balance mounted in the two bearings associated therewith. Then, the shake of the balance (of another rotating part) can be adjusting simply by rotating screw 34 using slot 44 provided at its top end opposite head 36, this top end being accessible by a tool from the top face 46 of the bar through aperture 42 passing through base 18. Once the adjustment is made, screw 32 is inserted into through hole 40 of adjusting screw 34 and tightened so as to fix base 18 rigidly to bottom plate 14. The resilient washer 48 holds adjusting screw 34 in the desired position. Once the distance between the two bearings has been finely adjusted by means of adjusting screw 34, the system for adjusting the height of bar 4 is concealed and the bar is securely fixed to the bottom plate.

It should be noted that the present invention can also apply to a timepiece movement fitted with a tourbillon and wherein the shake of the tourbillon carriage is adjusted using the device of the present invention associated with the tourbillon bar carrying one of the two bearings in which the tourbillon carriage pivots.

FIG. 6 shows a cross-section of a second embodiment of a timepiece fitted with means for adjusting the balance shake. This embodiment differs from the first embodiment of FIG. 1 in that it comprises two adjusting devices 34 according to the present invention respectively associated with the two bases 16 and 18 of bar 54. Thus, the relative distance between each of bases 16 and 18 and bottom plate 14 can be finely adjusted by means of the device 34 associated with each base. This second embodiment enables the shake of balance 6 to be adjusted while holding plate 10 horizontal, i.e. parallel to the general plane of the timepiece movement. Balance 6 has an arbour 56 whose two ends pivot respectively in bearings 58 and 60. Positioning studs or pins 54 can advantageously be provided, these pins or studs being introduced into corresponding holes of bottom plate 14. The height of each of the two bases 16 and 18 can be adjusted from the top face 46 of balance bar 54. The adjusting device formed by screw 34 associated with screw 32 will not be described here in detail again.

Figure 7:
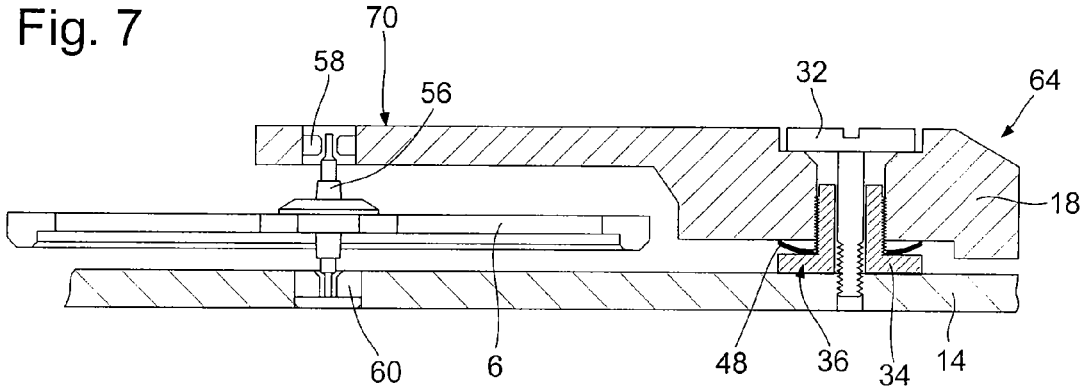
FIG. 7 is a cross-section of another embodiment with a balance bar comprising a single base.

FIG. 7 shows a cross-section of a third embodiment of a timepiece according to the invention wherein the balance bar 64 comprises a single base 18. Base 18 is associated with a device for adjusting the distance between the base and the bottom plate 14 of the type described above. Preferably, adjusting screw 34 has a head 36 of relatively large diameter to ensure that bar 64 is properly seated on bottom plate 14. Because tightening screw 32 is coaxial to adjusting screw 34, it is possible to secure bar 64 rigidly to bottom plate 14 and to keep plate 70 of said bar 64 substantially horizontal. By screwing or unscrewing screw 34 while screw 32 is not in place, the distance between the two bearings 58 and 60 can be precisely adjusted and optimum shake is thus obtained for balance 6.

What is claimed is:

1. A mechanical timepiece fitted with a rotating part, which includes an arbour, one end of which pivots in a first bearing carried by a bar and the other end pivots in a second bearing arranged in a bottom plate, said timepiece including means for adjusting the shake of said rotating part, wherein said adjusting means include at least one element for adjusting the distance between a base of said bar and said bottom plate, said adjusting device having a first hole for the passage of a tightening screw and being able to be actuated through a second hole machined in said base and passing therethrough, said tightening screw being introduced into said second hole to secure said base to said bottom plate but not being in place in said second hole when said adjusting device is actuated from the top face of said bar opposite said bottom plate and through said second hole in order to adjust the shake of the rotating part.

2. A timepiece according to claim 1, wherein said adjusting element is formed by a adjusting screw arranged to allow the distance between said base and said bottom plate to be varied by screwing in or unscrewing said adjusting screw.

3. The timepiece according to claim 2, wherein said adjusting screw is screwed into said second hole and said tightening screw is screwed into said bottom plate, said adjusting screw having a first end abutting against said bottom plate and a second end having a formed adapted to a tool for rotating the adjusting screw.

4. The timepiece according to claim 3, wherein said first end of said adjusting screw defines a head and said second end has a transverse slot for a screwdriver.

5. The timepiece according to claim 3, wherein said adjusting device has a threading with a fine pitch to allow fine adjustment of the distance between said first and second bearings.

* * * * *

UNITED STATES PATENT AND TRADEMARK OFFICE

CERTIFICATE OF CORRECTION

PATENT NO. : 7,287,900 B2
APPLICATION NO. : 11/616982
DATED : October 30, 2007
INVENTOR(S) : Christian Rüfenacht et al.

It is certified that error appears in the above-identified patent and that said Letters Patent is hereby corrected as shown below:

On the title page:

In the Assignee item [73]:

Please delete “Horlogére” and insert therefore --Horlogère--;

In the Foreign Priority Section: insert item [30]:

Please insert --EP 05028552.7 filed December 28, 2005--.

Signed and Sealed this

First Day of April, 2008

JON W. DUDAS
*Director of the United States Patent and Trademark Office*